United States Patent [19]

Lewis

[11] 4,305,634

[45] Dec. 15, 1981

[54] ELECTRICAL PLUG GUARD

[76] Inventor: John S. Lewis, 8525 Wolftrap Rd., Vienna, Va. 22180

[21] Appl. No.: 133,712

[22] Filed: Mar. 25, 1980

[51] Int. Cl.[3] ..... H01R 13/54

[52] U.S. Cl. ..... 339/75 R

[58] Field of Search ..... 339/36, 45 R, 74 R, 339/75 R, 75 P, 195 A, 195 S, 196 A

[56] References Cited

U.S. PATENT DOCUMENTS

| | | | |
|---|---|---|---|
| 1,802,230 | 4/1931 | Aletter | 339/74 R |
| 3,543,218 | 11/1970 | Archer | 339/75 P |
| 4,136,919 | 1/1979 | Howard et al. | 339/75 P |

*Primary Examiner*—Joseph H. McGlynn
*Attorney, Agent, or Firm*—Neil F. Markva

[57] ABSTRACT

The electrical plug guard comprises a disc member having a pair of elongated slots to frictionally receive the prongs of an electrical plug. The slots have centers offset with respect to each other along the length of the slots. The slots are effective to skew the prongs of the plug with respect to each other when the prongs are inserted in slots through the disc member. The disc member has a thickness sufficient to prevent finger contact with the prongs which are electrically active when partially inserted into an electrical plug outlet.

11 Claims, 10 Drawing Figures

ELECTRICAL PLUG GUARD

FIELD OF INVENTION

This invention relates generally to a safety device useful for preventing electrical shocks when inserting an electrical plug into an outlet. More particularly, the invention is directed to an electrical plug guard which fits over the prongs of an electrical plug to prevent accidental electrical shock to a user or a child playing with the plug.

BACKGROUND OF THE INVENTION

There is a need to prevent electrical shocks when inserting a plug into an electrical outlet. Small children who are playing with electrical plugs are particularly exposed to such possible electrical shocks. Such a possibility occurs when the prongs of the electrical plug are partially inserted into the sockets of the electrical outlet. These prongs become electrically active and it is very possible that the fingers of the user or a child may slip or accidentally move into contact with the electrically active prongs.

Many prior art devices have been produced for the purpose of avoiding such a problem. U.S. Pat. Nos. 2,759,160, 3,201,740, 3,629,790, 3,631,320, and 3,763,457 disclose typical prior art attempts to solve the basic problem. However, none of these prior art devices are practically useful because of their particular disposition on the electrical plug, electrical outlet or cover for the outlet. Many have moving parts which can become worn and damaged over a period of time. Others incorporate the use of adhesive material which can become ineffective after a plug has been inserted into the electrical outlet a plurality of times. Others, do not simply accomplish the result of keeping the fingers, particularly of a child, from gaining access to the electrically active prongs of a plug that is only partially inserted into an outlet receptacle.

SUMMARY OF THE INVENTION

The disc means of this invention is directly insertable onto the prongs of an electrical plug causing the prongs to be skewed with respect to each other. While the prongs are still insertable into an electrical plug outlet, it is more difficult to do so. Once plugged into the electrical receptacle, the skewed relationship of the prongs makes it more difficult to pull the receptacle out. Furthermore, the thickness of the disc means is sufficient to enable the disc means to act as a barrier between the electrically active prongs or blades and the fingers of a person when the plug is partially inserted into the electrical receptacle.

The disc means has a pair of elongated slots to frictionally receive the prongs or blades of an electrical plug. The slots have their centers offset with respect to each other along the lengths of the slots. Thus, the slots are effective to skew the prongs or blades of the electrical plug with respect to each other when the prongs are inserted in the slots through the disc means. The disc means has a width sufficient to extend outwardly from the periphery of the electrical plug having its prongs inserted completely into the slots.

Another feature of the invention is that the disposition of the slots with respect to each other on the disc means is effective to cause each of the electrical prongs or blades inserted therein to twist along its own longitudinal axis. Because the slots are parallel with respect to each other, the blades remain in a parallel relationship with respect to each other upon insertion of the prongs through the disc means.

Another feature of the invention is that the disc means comprises a disc member composed of rigid, non-resilient material that is electrically non-conductive. The disc member has a thickness that is sufficient to act as a guard or barrier with respect to the bare "hot blade" portion when the electrical plug is partially inserted into an electrical receptacle. That is, the thickness must be sufficient to protect the fingers of a person on bare blades which may be exposed up to ¼ of an inch when the electrical plug is partially inserted into an electrical outlet. The thickness of the disc member may also be considered effective to cause the plug to be electrically disengaged from an electrical outlet when a finger is inserted between the disc member and the electrical outlet. The outer shape and size of the disc member is effective to allow a plurality of plugs to be inserted at one electrical outlet box.

BRIEF DESCRIPTION OF DRAWINGS

Other objects of this invention will appear in the following description and appended claims, reference being made to the accompanying drawings forming a part of the specification wherein like reference characters designate corresponding parts in the several views.

DETAILED DESCRIPTION

Figure 1:
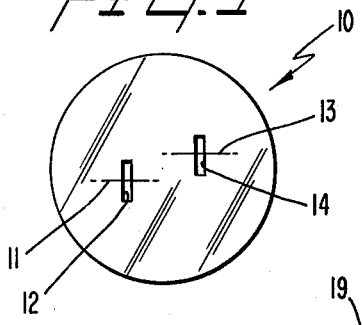
FIG. 1 is an elevational view of a disc member made in accordance with this invention.
Figure 2:
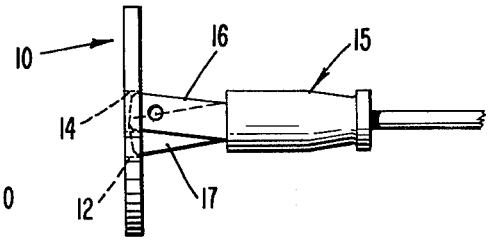
FIG. 2 is a side elevational view of a disc member partially disposed over the end of electrical plug prongs.
Figure 3:
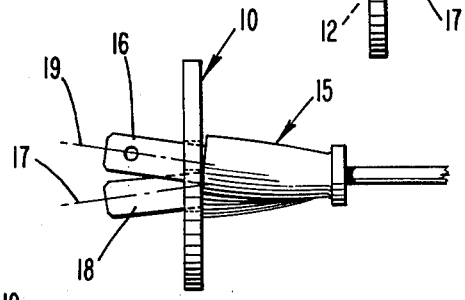
FIG. 3 is a side elevational view of a disc member of the invention shown disposed in its working position on the electrical plug prongs.

The disc member, generally designated 10, includes a pair of elongated slots 12 and 14 which frictionally receive the prongs 16 and 18 of an electrical plug 15. Slots 12 and 14 have centers 11 and 13, respectively, which are offset with respect to each other along the lengths of the slots. The slots are effective to skew the prongs 16 and 18 as shown with respect to each other when the prongs are inserted therein. As shown in FIG. 3, the prongs are partially inserted through the disc member 10.

Figure 4:
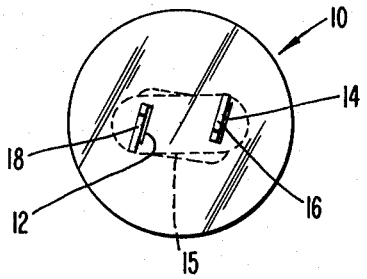
FIG. 4 is a front elevational view of the combination shown in FIG. 3.
Figure 5:
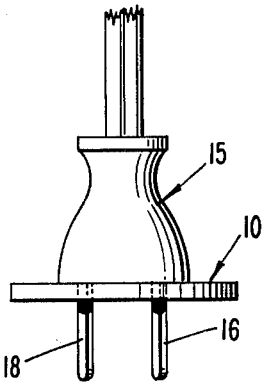
FIG. 5 is a view along V—V of FIG. 4.

In the front elevational view of FIG. 4, the prongs 16 and 18 are shown to be twisted along their own respective longitudinal axes 17 and 19.

Figure 6:
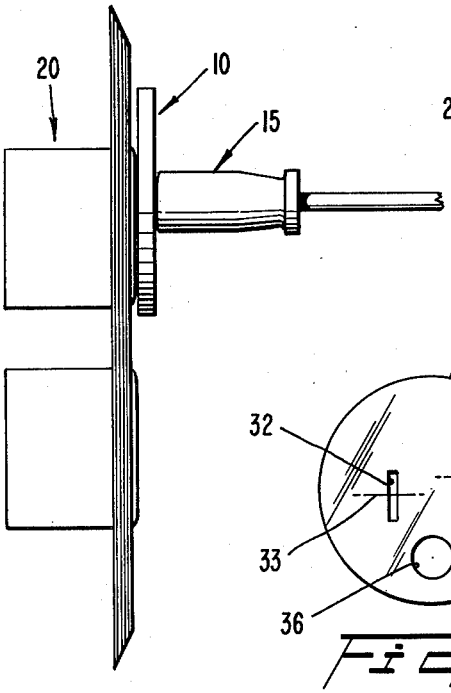
FIG. 6 is a side elevational view of an assembly showing the disc member disposed on the prongs of an electrical plug inserted into an electrical outlet.

When the electrical plug 15 is inserted into the outlet 20, the frictional force is increased. Thus it makes it more difficult for a small child to put the plug into an electrical outlet in the first instance. Furthermore, once the plug has been completely inserted into the electrical outlet as shown in FIG. 6, it becomes more difficult for the plug to be removed. If the child is strong enough to pull the plug partially out or to partially insert the same in the electrical outlet, the size and shape of the disc 10 is sufficient to prevent finger contact with the blades 16 and 18 which become electrically active when only partially inserted into the outlet 20.

Figure 7:
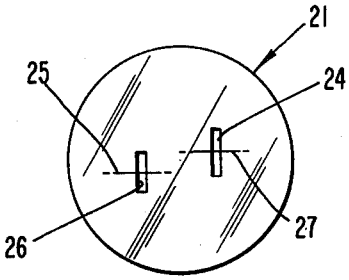
FIG. 7 is a front elevational view of another embodiment of a disc member made in accordance with this invention.
Figure 8:
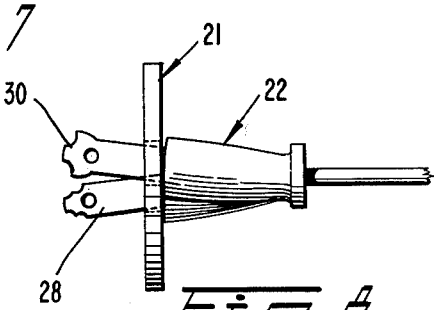
FIG. 8 is a side elevational view of the embodiment shown in FIG. 7 disposed on an electrical plug.

The embodiment shown in FIGS. 7 and 8 are particularly adapted to the polarized plug. That is, slot is longer than slot to receive electrical prongs 30 and 28, respectively, which have different lengths along their widest cross-sectional measurement as shown. The centers 25 and 27 are still offset with respect to each other along the length of the slots 24 and 26, respectively.

Figure 9:
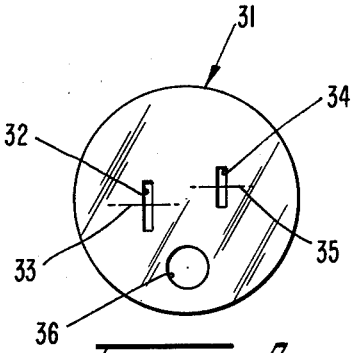
FIG. 9 is a further embodiment of a disc member made in accordance with this invention.
Figure 10:
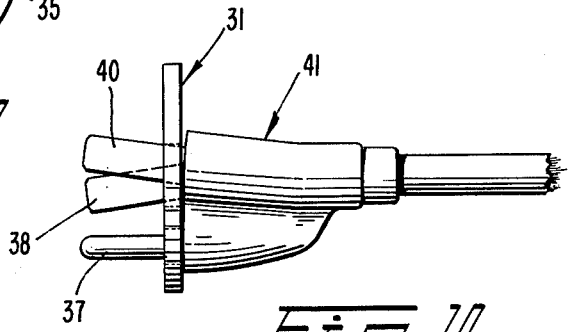
FIG. 10 is a side elevational view of the embodiment of FIG. 9 disposed on an electrical plug.

The embodiment as shown in FIGS. 9 and 10 incorporates an opening 36 along with the elongated slots 32 and 34. This disc member 31 is particularly adapted to a three-prong plug having a ground prong 37 along with the electrical prongs 38 and 40. Again, the centers 33 and 35 of the respective slots 32 and 34 are offset with respect to each other.

The disc members in these particular embodiments have circular shapes and a thickness of about 5/32 inch. The centers are offset by about 0.07 inch. These values, of course, may vary depending upon the particular electrical plug to which the disc member of the invention is to be adapted. Some plug members have prongs which are disposed in planes which are transverse with respect to each other. These include plugs found in countries outside the United States. However, the offset center relationship of the slots may be expressed in the same manner as expressed for prongs disposed parallel with respect to each other. The disc members are composed of rigid, non-resilient material that is electrically non-conductive. The material may be of clear transparent material or may be colored, depending upon the particular decor desired. The shaped outer contour of the disc may be varied within the context of the invention.

While the electrical plug guard has been shown and described in detail, it is obvious that this invention is not to be considered as being limited to the exact form disclosed, and that changes in detail and construction may be made therein within the scope of the invention, without departing from the spirit thereof.

Having thus set forth and disclosed the nature of this invention, what is claimed is:

1. An electrical plug guard comprising:

(a) a disc means having a pair of elongated slots to frictionally receive the prongs of an electrical plug, (b) said slots having centers offset with respect to each other along the length of the slots, (c) said slots being effective to skew the prongs of the plug with respect to each other when the prongs are inserted in the slots through the disc means.

2. A guard as defined in claim 1 wherein the disc means has a thickness sufficient to prevent finger contact with the prongs which are electrically active when partially inserted into an electrical plug outlet.

3. A guard as defined in claim 1 wherein the disc means has a width sufficient to extend outwardly from the periphery of said plug having its prongs inserted in said slots.

4. A guard as defined in claim 1 wherein the disposition of the slots with respect to each other is effective to cause each of the prongs inserted therein to twist along its own longitudinal axis.

5. A guard as defined in claim 1 wherein said disc means includes an opening to receive a ground prong of an electrical plug.

6. A guard as defined in claim 1 wherein one of the slots is longer than the other slot to receive electrical prongs having different lengths along their widest cross-sectional measurement.

7. A guard as defined in claim 1 wherein the disc means is composed of rigid, non-resilient material which is electrically non-conductive.

8. A guard as defined in claim 1 wherein the slots are parallel with respect to each other.

9. A guard as defined in claim 1 wherein the disc means comprises a disc member having a shaped outer contour and a thickness sufficient to prevent finger contact with said prongs which are electrically active when partially inserted into an electrical plug outlet.

10. A guard as defined in claim 9 wherein the disc member has a circular shape and a thickness of about 5/32 inch.

11. A guard as defined in claim 9 wherein the thickness of the disc means is effective to cause the plug to be electrically disengaged from an electrical outlet when a finger is inserted between the disc means and the electrical outlet.

* * * * *